United States Patent [19]

Brown

[11] 4,308,808

[45] * Jan. 5, 1982

[54] COAL BURNING METHOD TO REDUCE PARTICULATE AND SULFUR EMISSIONS

[75] Inventor: Melvin H. Brown, Freeport, Pa.

[73] Assignee: Aluminum Company of America, Pittsburgh, Pa.

[ * ] Notice: The portion of the term of this patent subsequent to Nov. 11, 1997, has been disclaimed.

[21] Appl. No.: 183,617

[22] Filed: Sep. 2, 1980

Related U.S. Application Data

[63] Continuation-in-part of Ser. No. 47,004, Jun. 11, 1979, Pat. No. 4,232,615.

[51] Int. Cl.[3] ..... F23K 1/02; F23N 3/00

[52] U.S. Cl. ..... 110/342; 110/347; 48/DIG. 7

[58] Field of Search ..... 110/342, 343, 344, 345, 110/347, 348, 214, 218; 431/10; 423/244 A; 48/DIG. 7

[56] References Cited

U.S. PATENT DOCUMENTS

| | | | |
|---|---|---|---|
| 1,007,153 | 10/1911 | Spurrier . | |
| 1,167,471 | 1/1916 | Barba . | |
| 1,545,620 | 7/1925 | Trent . | |
| 1,955,574 | 4/1934 | Benner et al. | 110/28 |
| 2,800,172 | 7/1957 | Romer et al. | 158/1 |
| 3,228,451 | 1/1966 | Fraser et al. | 158/117.5 |
| 3,313,251 | 4/1967 | Jonakin | 110/7 |
| 3,540,387 | 11/1970 | McLaren et al. | 110/1 |
| 3,717,700 | 2/1973 | Robison et al. | 423/244 |
| 4,102,277 | 7/1978 | Wall | 110/342 |
| 4,144,017 | 3/1979 | Barsin et al. | 431/10 |

OTHER PUBLICATIONS

A Comprehensive Treatise on Inorganic and Theoretical Chemistry by J. W. Mellor, vol. X, S18, pp. 282–284, "The Alkaline Earth Sulphites".

*Primary Examiner*—Henry C. Yuen
*Attorney, Agent, or Firm*—David J. Hill

[57] ABSTRACT

A method is disclosed for burning a pulverized carbonaceous material containing sulfur and ash. According to this method, a slurry is formed containing the carbonaceous material, water, a reagent adapted to react during combustion with the sulfur in the material and a cementing agent adapted to reduce particulate emissions during combustion. The slurry is burned in a first stage with less than 100% theoretical air and preferably at a temperature below about 1100° C. The products of combustion from the first stage are removed to a second stage and burned with additional air.

15 Claims, 1 Drawing Figure

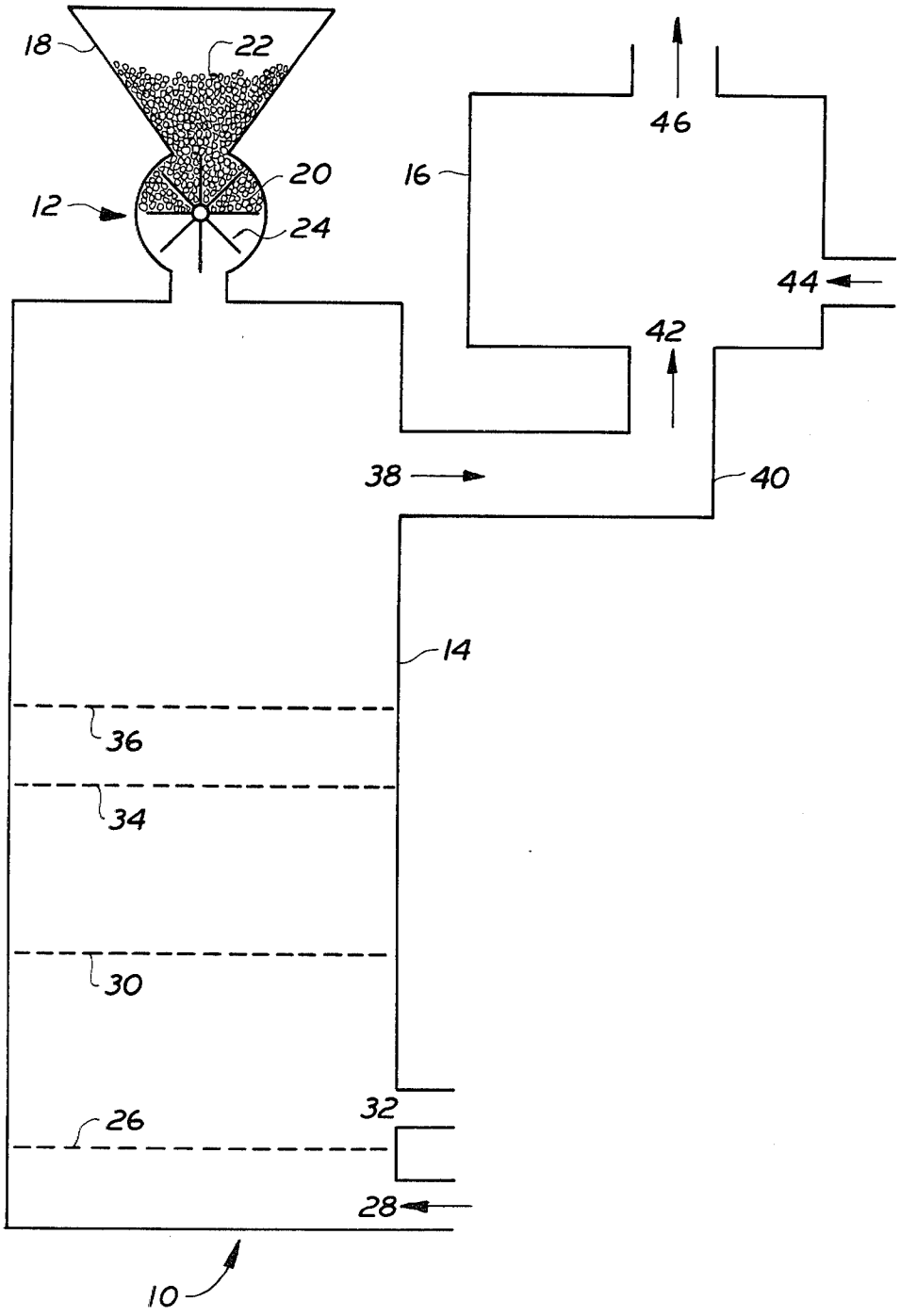
18
22
20
12
24
16
46
44
42
38
40
14
36
34
30
26
32
28
10

COAL BURNING METHOD TO REDUCE PARTICULATE AND SULFUR EMISSIONS

CROSS-REFERENCE TO RELATED APPLICATION

This application is a continuation-in-part of U.S. Patent Application Ser. No. 47,004, filed June 11, 1979, now U.S. Pat. No. 4,232,615.

BACKGROUND OF THE INVENTION

The present invention relates to a method for burning a carbonaceous material such as coal. More particularly, the invention relates to a method for burning a pulverized carbonaceous material in the form of a waterbased slurry to reduce the emission of particulates and sulfur compounds in the combustion gases.

In the combustion of carbonaceous materials containing sulfur and ash, such as coal, the gases of combustion may contain sulfur compounds representing a major portion of the sulfur found in the material, as well as ash particulates. Since these sulfur compounds and particulates may constitute significant environmental hazards, much work has been devoted to the development of methods for preventing formation of these substances or cleansing them from the combustion gases.

One method for the combustion of a carbonaceous material such as coal in a manner which is aimed at a reduction in the sulfur content of the combustion gases is described in U.S. Pat. No. 3,540,387 of McLaren et al. According to this method, the carbonaceous material and a specified amount of a carbonate, such as calcium carbonate, are fed into a fluidized bed of ash, where the carbonaceous material is burned at a temperature within the range of 700°-900° C. The practice of this method reportedly reduces the sulfur content of the gases of combustion because the presence of the carbonate leads to ready retention of the sulfur in the ash produced in the combustion process.

A method for operating a powdered coal combustion furnace in such a way as to control the form in which ash is produced therein, in order to minimize problems associated with disposal of the ash, is described in U.S. Pat. No. 1,955,574 of Benner et al. According to this method, a reagent is added during combustion which alters the melting point of the coal ash so that a substantially uniform temperature differential is maintained between the melting point of the ash and the flame temperature of combustion. The method of Benner et al. recites that the melting point of the ash may generally be raised by the addition of sand or a non-ferruginous clay to the coal, and that the addition of lime or soda to the coal will lower its ash melting temperature.

In the preferred embodiment of the Benner et al. method, a reagent is added to maintain the melting point of the ash at a substantially definite point below the flame temperature. When this is accomplished, a thin layer of solid or very viscous ash is reportedly built up on the inside walls of the furnace. Additional ash that may accumulate during combustion remains in a liquid state and does not form deposits on the furnace walls. This liquid ash collects in the bottom of the furnace where it may be readily removed. A second embodiment of the method of Benner et al. operates to increase the melting point of the ash to a point above the flame temperature in order that the ash may be removed as a powder.

In addition to the efforts that have been made to alleviate the environmental problems associated with the presence of sulfur and ash in carbonaceous materials such as coal, work has been carried out to reduce the sulfur content of metallurgical coke which is produced from coal. One such method for producing low-sulfur coke from coal is described in U.S. Pat. No. 1,545,620 of Trent. According to this method, coal is finely pulverized and then saturated with water. Powdered limestone (calcium carbonate) is mixed with hydrocarbon oil and this mixture is added to the water-saturated or -suspended coal particles to form a plastic mass in which there is a close association between the sulfur and the limestone. Trent teaches that when this mass is coked, some of the sulfur is separated from the coal as sulfur gases, but the predominant portion thereof chemically combines with the limestone and forms calcium sulfide in the coke.

A method for treating coke which contains sulfur in order to reduce the chance that the sulfur will unite with the metal produced in a blast furnace in which the coke is used is described in U.S. Pat. No. 1,007,153 of Spurrier. According to this method, sodium carbonate or a salt, hydrate or oxide of one of the alkali metals is dissolved in water and the solution is poured over the coke. The water is then permitted to evaporate. As taught by Spurrier, this leaves the alkali compound in the pores of the coke where it may react with the sulfur upon combustion to form sulfates and sulfides of the alkali metal.

It is apparent from the foregoing that the addition of various additives to carbonaceous materials during or prior to their heating or combustion is known for the purposes of reducing or controlling the liberation of sulfur compounds and ash during the heating or combustion. It is also known that certain advantages inhere in the handling of carbonaceous materials in the form of a waterbased slurry. For example, some such slurries may be pumped like a liquid fuel. In addition, water-based coal slurries may be handled without dust problems and may be stored without the fear of spontaneous combustion.

Various methods for the burning of coal slurries are also known. For example, U.S. Pat. No. 3,313,251 of Jonakin describes a method by which a pipeline coal slurry may be mechanically dewatered and burned in a cyclone furnace. According to this method, coal slurries containing 50–70% crushed coal and the remainder water may be pumped through a pipeline to a dewatering centrifuge, where a portion of the water is removed, leaving a slurry containing about 20% water. This low-water slurry is admitted to a cyclone furnace for combustion. The temperature in the furnace is maintained above the melting temperature of the ash in the coal so that a molten ash residue is produced by the combustion process. The centrifugal action produced in the cyclone causes this residue to impinge on the furnace walls; however, under the influence of gravity, it flows to the bottom of the furnace where it may be removed.

Another method for burning a carbonaceous material such as coal in the form of a water-based slurry is described in my co-pending U.S. Patent Application Ser. No. 47,004, now U.S. Pat. No. 4,232,615, entitled "Coal Burning Method to Reduce Particulate and Sulfur Emissions". According to this method, a slurry is formed which contains the carbonaceous material, water and a reagent adapted to reach during combustion with the sulfur. The slurry may also contain a particulate binding agent adapted to reduce particulate emissions during combustion. The slurry is burned in a first stage with less than 100% theoretical air and preferably at a temperature below about 1100° C. The products of combustion from this first stage are then removed to a second stage and burned with additional air.

The method of the aforementioned application provides for reduced emission of ash particulates and sulfur compounds in the combustion gases and for ease of handling of the fuel by virtue of its pumpable, slurry form. However, it has been found, in the practice of this method, that at relatively high velocities of combustion air into the first stage combustion chamber, such as about 0.3 meters/sec., solid particles in the fuel slurry may become entrained in the air and may be emitted as particulates in the exhaust from the second stage combustion chamber.

SUMMARY OF THE INVENTION

In spite of the progress that has been made in controlling sulfur and ash emissions from the combustion of carbonaceous materials, improvements in handling and combustion techniques are continually required, especially in light of the continuing interest in air pollution control and the inevitable reduction in permissable levels of pollutants. Therefore, it is an object of the present invention to provide a method and apparatus for burning a carbonaceous material such as coal in such a manner as to reduce the emission of ash particulates and sulfur compounds in the combustion gases. It is a further object of this invention to provide a method for burning such material in an easily handled slurry, the constituents of which will not be dispersed and entrained by high velocity combustion air.

In accordance with these and other objects, a method is disclosed for burning a pulverized carbonaceous material containing sulfur and ash. According to this method, a slurry is formed which contains the carbonaceous material, water, a reagent adapted to react during combustion with the sulfur and a cementing agent adapted to reduce particulate emissions during combustion. The slurry may also contain a particulate binding agent which also aids in reducing particulate emissions during combustion. The slurry is burned in a first stage with less than 100% theoretical air and preferably at a temperature below about 1100° C. The products of combustion from this first stage are then removed to a second stage and burned with additional air.

In order to facilitate an understanding of the invention, reference is made to the application of the method by means of the apertures illustrated in the accompanying drawing. It should be understood nevertheless that it is not intended that the invention be limited to the particular embodiments shown or described. Various changes and alterations are contemplated as would ordinarily occur to one skilled in the art to which the invention relates.

BRIEF DESCRIPTION OF THE DRAWING

The sole drawing is a cross-sectional schematic illustration of a preferred apparatus useful in the practice of the method of this invention.

DESCRIPTION OF THE PREFERRED EMBODIMENTS

In the practice of the method of this invention, a slurry is prepared which includes a pulverized carbonaceous material containing sulfur and ash, such as coal, water, a reagent adapted to react during combustion with the sulfur and a cementing agent adapted to reduce particulate emissions during combustion. The slurry may also include a particulate binding agent.

Since the carbonaceous material in the slurry is pulverized, the reagent may intimately associate with the material. When the slurry is heated during the first stage of combustion, a reaction between the slurry constituents and the oxygen in the air of combustion forms sulfur compounds such as hydrogen sulfide, carbonyl sulfide and sulfur dioxide. These compounds may then react with the reagent to form sulfites and sulfates. Some of the sulfites thus produced are thermally unstable at high temperatures. Thus, for example, calcium sulfite begins to decompose to calcium oxide and sulfur dioxide at about 900° C., and it is almost completely unstable at temperatures above 1100° C. Most of these compounds, however, especially the sulfides, are thermally stable at temperatures somewhat higher than 1100° C. Nevertheless, because of the thermal instability of the sulfites, it is preferred that the temperature in the first stage combustion chamber be maintained below about 1100° C. during combustion. This may be accomplished by introducing steam into the chamber with the combustion air, or more preferably, by limitation of the amount of air introduced into the chamber to less than 100% theoretical air. However, limitation of the amount of air introduced into the first chamber to less than 100% theoretical air also causes the major portion of the sulfur in the carbonaceous material to form sulfides which remain bound in the ash upon combustion, and consequently are not available for further reaction in the second stage combustion chamber to form sulfide oxides. Thus, the emission of sulfur oxides may be significantly reduced by limitation of the amount of air introduced into the first stage combustion chamber to less than 100% theoretical air. A further reduction in sulfur oxide emissions may be achieved by limitation of the amount of air introduced in such a manner that the temperature in the first stage combustion chamber is maintained below about 1100° C. during combustion. Of course, when the chamber is operated in this preferred manner, localized hot spots may exist in the chamber at temperatures above 1100° C., and the presence of such hot spots is considered to be within the scope of the preferred embodiment of the invention. However, the major portion of the first stage combustion should preferably be carried out at a temperature below about 1100° C., and most preferably at a temperature between about 850° C. and 1050° C. The operation of the first stage combustion chamber with less than 100% theoretical air also reduces the formation of oxides of nitrogen by reaction of nitrogen compounds in the carbonaceous material with oxygen in the air.

The inclusion of a reagent in the slurry will also alter the melting temperature of the ash. The selection of a reagent for use in the slurry should therefore accommodate the desired method of ash disposal. Experimentation has shown, in spite of the teaching of Benner et al., that certain reagents, such as calcium oxide, calcium carbonate, dolomite and magnesium oxide, will act to increase the melting temperature of the ash. Inclusion in the slurry of these reagents will therefore facilitate removal of the ash as a solid from the bottom of the combustion chamber. Other reagents, such as sodium carbonate, sodium bicarbonate and clay, will act to decrease the melting temperature of the ash. Use of these reagents in the preparation of the slurry will facilitate removal of the ash in liquid form. Under certain circumstances, it may be desirable to utilize a reagent comprised of a mixture of these preferred materials.

The use of water in the slurry provides several important advantages. It acts as a vehicle for the fuel, allowing it to be handled as a liquid or as a stiff paste. It also promotes the intimate association of the reagent with the pulverized carbonaceous material that is necessary to maximize the effect of the reagent. A water-based slurry may also be stored without fear of spontaneous combustion or excessive dust generation.

The inclusion of a cementing agent in the slurry will reduce particulate emissions during combustion by reacting with the water in the slurry to bond together the carbonaceous particles in the slurry prior to combustion. This bonding allows high velocity combustion air to be introduced into the first stage combustion chamber without the subsequent danger of dispersal and entrainment of solid particles of the fuel slurry in the exhaust from the second stage combustion chamber. The introduction of high velocity combustion air into the first stage combustion chamber is desirable because it increases the rate of which the carbonaceous material may be burned, and thus the rate at which energy may be extracted. Suitable cementing agents for use in this invention are calcium oxide, portland cements, natural cements and other hydraulic cements known to those skilled in the art. Calcium oxide is the preferred cementing agent because it may also serve as the reagent. In a preferred embodiment of the invention, the reaction of the cementing agent with the water in the slurry is allowed to proceed for about one hour prior to burning. When the reaction is allowed to proceed in this way, the slurry will harden in the manner of a cement. Such hardening is facilitated when the amount of water in the slurry is limited to 45% or less by weight.

A preferred embodiment of the slurry contains a particulate binding agent, which aids in the reduction of particulate emission during combustion. This reduction may be due to a binding of the carbonaceous particles that occurs when the binding agent is present in the slurry during the initial heating thereof in the first stage combustion chamber prior to combustion. Preferred binding agents for addition to the slurry include clay, sucrose, calcium acetate and acetic acid.

Referring now to the drawing, combustion apparatus 10 is generally preferred for practice of the method of this invention. The apparatus includes slurry feeder 12, which is particularly adapted for feeding of a slurry that has been allowed to harden, first stage combustion chamber 14 and second stage combustion chamber 16.

The slurry feeder includes a reservoir 18 and a dispensation chamber 20. Reservoir 18 contains a quantity of fuel slurry 22 which passes to chamber 20 for dispensation into the first stage combustion chamber. Such dispensation may be achieved by rotation of rotary vane 24, or by use of any other suitable dispensing apparatus known to those skilled in the art. For slurries that are to be burned before the reaction of the cementing agent with the water proceeds long enough to produce appreciable hardening, a suitable dispensing apparatus is illustrated in the aforementioned Patent Application Ser. No. 47,004, U.S. Pat. No. 4,232,615. From feeder 12, the slurry is dispensed into the upper portion of chamber 14. This chamber contains a grate 26 in its lower portion, which supports the fuel and ash during combustion. Air for combustion in the first stage enters below grate 26 at inlet 28. As has been mentioned, less than 100% theoretical air is supplied in the first stage, preferably in such a way as to maintain the temperature therein below about 1100° C.

During combustion, several zones are established within chamber 14. When the slurry contains a reagent such as calcium oxide, the melting temperature of the ash will be above the temperature in chamber 14, and the ash will accumulate in the form of a solid in the bottom of the chamber. An ash zone will therefore be established in the lower part of the chamber, between grate 26 and a level generally designated at 30. As ash accumulates during the first stage of combustion, it may be removed from chamber 14 through ash disposal port 32.

Atop the ash is the fuel from feeder 12. A part of this fuel undergoes combustion in a combustion zone located generally between levels 30 and 34. Above the combustion zone is a slurry zone, located generally between levels 34 and 36, where newly deposited slurry from feeder 12 is not undergoing combustion. As the fuel in the combustion zone is consumed and as the water in the slurry is evaporated by the heat of combustion, the carbonaceous material in the slurry in the slurry zone enters the combustion zone where it is burned.

The combustible gases from chamber 14 exit the chamber at outlet 38, and pass through conduit 40 to second stage combustion chamber 16. Entering this chamber at inlet 42, these gases are mixed with additional air from air inlet 44 and combustion is completed. The exhaust from chamber 16 exits through exhaust outlet 46 for discharge to the atmosphere or further treatment.

In order to illustrate the method of this invention, slurries were formed containing pulverized coal with an ash content of 9.69% and a total sulfur content of 3.53%. The slurries were burned in a combustion apparatus substantially as has herein been described. The slurry composition, amount of air admitted to the first stage combustion chamber, amount of additional air admitted to the second stage chamber, first stage combustion temperature and amount of sulfur oxide and particulate emissions from the second stage for each combustion test are listed in the following table:

| Test No. | Slurry Composition (Percentages by Weight) | First Stage Air (% of Theoretical) | Additional Air Second Stage (% of Theoretical) | First Stage Combustion Temp. (°C.) | Sulfur Oxide Emission from Second Stage (Kg/$10^9$ Joule) | Particulate Emission from Second Stage (Kg/$10^9$ Joule) |
|---|---|---|---|---|---|---|
| 1 | 55.6% Coal<br>36.1% Water<br>8.3% Calcium Oxide | 33.0 | 53.0 | 925 | 0.11 | 0.03 |
| 2 | 55.6% Coal<br>36.1% Water<br>8.3% Calcium Oxide | 45.0 | 30.0 | 950 | 0.02 | 0.06 |

-continued

| Test No. | Slurry Composition (Percentages by Weight) | First Stage Air (% of Theoretical) | Additional Air Second Stage (% of Theoretical) | First Stage Combustion Temp. (°C.) | Sulfur Oxide Emission from Second Stage (Kg/$10^9$ Joule) | Particulate Emission from Second Stage (Kg/$10^9$ Joule) |
|---|---|---|---|---|---|---|
| 3 | 55.6% Coal<br>36.1% Water<br>8.3% Calcium Oxide | 35.0 | 56.0 | 925 | 0.07 | 0.00 |
| 4 | 54.1% Coal<br>40.5% Water<br>5.4% Calcium Oxide | 57.7 | 76.7 | 1093 | 0.77 | 0.10 |
| 5 | 50.0% Coal<br>42.5% Water<br>7.5% Calcium Oxide | 66.8 | 88.9 | 1093 | 0.24 | 0.11 |
| 6 | 46.5% Coal<br>41.9% Water<br>11.6% Calcium Oxide | 61.1 | 81.3 | 1093 | 0.18 | 0.13 |
| 7 | 50.2% Coal<br>40.2% Water<br>7.6% Calcium Oxide<br>2.0% Clay | 90.9 | 120.9 | 996 | 0.48 | 0.04 |
| 8 | 46.7% Coal<br>44.4% Water<br>7.0% Calcium Oxide<br>1.9% Clay | 81.7 | 81.7 | 843 | 0.03 | 0.08 |
| 9 | 46.7% Coal<br>43.2% Water<br>7.0% Calcium Oxide<br>1.9% Clay<br>0.6% Sucrose<br>0.6% Acetic Acid | 94.8 | 94.8 | 927 | 0.16 | 0.02 |

After the slurries were formed in Tests 1–3, the reaction of the cementing agent with the water was allowed to proceed for about one hour before the slurries were burned. Thus, these slurries were allowed to harden before they were burned.

It should be understood that the above description of the present invention is susceptible to various modifications, changes and alterations, and the same are intended to be included within the meaning and range of the appended claims. For example, combustion of the combustible gases from the first stage combustion chamber may be carried out in a second stage chamber remote from the first stage. In addition, the second stage chamber could be associated with a boiler, melting furnace, gas turbine or other such device such as are known to those skilled in the art.

What is claimed is:

1. A method for burning a pulverized carbonaceous material containing sulfur and ash, comprising forming a slurry containing the carbonaceous material, water, a reagent adapted to react with the sulfur and a cementing agent, burning the slurry in a first stage with less than 100% theoretical air, removing the combustible gases from the first stage to a second stage, and burning the gases in the second stage with additional air.

2. The method of claim 1 wherein the slurry is burned in the first stage at a temperature below about 1100° C.

3. The method of claim 1 wherein the slurry is burned in the first stage at a temperature between about 850° C. and 1050° C.

4. The method of claim 1 wherein the amount of water in the slurry is not more than 45% by weight.

5. The method of claim 1 wherein the cementing agent is calcium oxide.

6. The method of claim 1 wherein the amount of reagent in the slurry is not less than the stoichiometric amount necessary to react with the sulfur.

7. The method of claim 1 wherein the reagent is selected from the group consisting of calcium oxide, calcium carbonate, dolomite, magnesium oxide, sodium carbonate, sodium bicarbonate, clay and mixtures thereof.

8. The method of claim 1 wherein the reagent is adapted to reduce the melting temperature of the ash.

9. The method of claim 1 wherein the reagent is adapted to increase the melting temperature of the ash.

10. The method of claim 1 wherein the air in the first stage is introduced at a velocity of at least 0.3 meters/-sec.

11. The method of claim 1 wherein the slurry contains a particulate binding agent.

12. The method of claim 11 wherein the amount of binding agent in the mixture is at least 2% by weight.

13. The method of claim 11 wherein the binding agent is selected from the group consisting of clay, sucrose, calcium acetate, acetic acid and mixtures thereof.

14. A method of burning a pulverized carbonaceous material containing sulfur and ash, comprising forming a slurry containing between 45% and 65% by weight of the carbonaceous material, between 30% and 45% by weight water and between 5% and 15% by weight calcium oxide, allowing the slurry to harden by reaction of the water with the calcium oxide, burning the slurry in a first stage with less than 100% theoretical air, removing the products of combustion from the first stage to a second stage, and burning the products in the second stage with additional air.

15. The method of claim 14 wherein the slurry is allowed to harden for about one hour.

* * * * *